United States Patent [19]

Gannicott

[11] 4,102,253

[45] Jul. 25, 1978

[54] COUNTING AND STACKING UNIT

[76] Inventor: David James H. Gannicott, 22 Nuffield Dr., Scarborough, Canada

[21] Appl. No.: 735,688

[22] Filed: Oct. 26, 1976

[51] Int. Cl.[2] ..... B31B 1/98

[52] U.S. Cl. ..... 93/93 C; 271/64; 271/80

[58] Field of Search ..... 271/80, 221, 222, 64; 83/106; 93/93 C, 93 R, 93 DP

[56] References Cited

U.S. PATENT DOCUMENTS

| | | | |
|---|---|---|---|
| 1,985,547 | 12/1934 | Quick et al. | 271/80 X |
| 2,992,823 | 7/1961 | Forrester | 271/222 |
| 3,182,537 | 5/1965 | Grody | 93/93 C X |
| 3,550,493 | 12/1970 | Benbenek | 93/93 C UX |
| 3,980,183 | 9/1976 | Anikanov et al. | 271/80 X |

FOREIGN PATENT DOCUMENTS

| | | | |
|---|---|---|---|
| 1,254,950 | 11/1967 | Fed. Rep. of Germany | 93/93 C |

*Primary Examiner*—James F. Coan

[57] ABSTRACT

A counting and stacking unit having a delivery path for delivery of forms from the collating and gluing unit to two stacking units, and in which the delivery path at a predetermined point is divided into two delivery paths, one going to one stacking unit and the other going to the other stacking unit, and including a gate system at the junction of said delivery paths for diverting forms down one or other of said paths, and counting means for counting the number of forms being stacked, and operating the diverting gate at a predetermined count.

14 Claims, 31 Drawing Figures

C

COUNTING AND STACKING UNIT

The present invention relates to apparatus for counting and stacking multi-part business forms.

BACKGROUND OF THE INVENTION

In the manufacture of multi-part business forms, it is customary to print the various sheets of the form on separate continuous rolls of paper.

The continuous rolls or webs of paper bearing the different parts of the form are then run through a collating and gluing machine in which the various parts of the form are overlaid one with the other, and are interleaved with sheets of carbon paper. An edge or two edges of the form are glued in such a machine, and the completed multi-part form sets are then cut off and stacked.

It is highly desirable that the number of form sets in the stacks should be as near as possible exact. In the past the counting of forms has been somewhat inaccurate. In addition, it has involved the use of an extra employee on the stacking unit with consequent increase in operating cost. In addition, it has generally speaking not proved to be practical to run such stacking units above a predetermined relatively low speed. This in turn has limited the speed at which the collating and gluing units could be run. All of this therefore greatly increases the cost of manufacturing multi-part business forms.

Various problems arise in connection with automatic counting and stacking of multi-part business forms at a high speed. For example, different multi-part form sets may be of different thicknesses. The various sheets of the forms are relatively thin and flimsy and are liable to become unglued or dislodged, and require to be handled with great care. Excessive pressure during counting and stacking of such form sets may result in carbon impressions being produced on the lower copies of the forms which will detract from their appearance.

The faster such machines are run, the more difficult it is for an operator to control the counting and stacking of individual bundles of such forms.

The automatic stacking of such multi-part forms also involves a requirement for jogging the stacks of forms so that they are square. This in turn presents something of a problem since each multi-part form set is itself a bundle of as many as five sheets of paper and four sheets of carbon and is therefore relatively bulky. In addition the size and bulk of each of such multi-part forms creates a further problem in that as the speed of operation of such a stacking machine is increased, the velocity of the form set is greatly increased. Any impact between such a form moving at high speed and a stationary part of the machine will therefore produce a tendency for the form to buckle or be deflected causing further problems.

When starting up the collating and gluing machine it is inevitable that the first few collated and glued forms will be faulty for some reason. It is desirable that they should be rejected and not passed through for stacking.

In the past the rejection of faulty forms has usually been carried about by visual inspection and manual selection. Again, this is unsatisfactory for high speed operation.

In order to run a stacking machine at high speed, it has been found that it is generally speaking preferable to operate with two alternate stacking stations. One stack of a predetermined number will be completed at one station after which the supply of forms will be diverted to the other stacking station and so on to and fro.

The diverting of the forms from one station to the other also presents a problem since if a precise count of forms in each stack is to be achieved, then the diversion must take place in timed relationship to the stacking of the forms.

BRIEF SUMMARY OF THE INVENTION

The invention seeks to provide a counting and stacking unit having a delivery path for delivery of forms from the collating and gluing unit to two stacking units, and in which the delivery path at a predetermined point is divided into two delivery paths, one going to one stacking unit and the other going to the other stacking unit, and including a gate system at the junction of said delivery paths for diverting forms down one or other of said paths, and counting means for counting the number of forms being stacked, and operating the diverting gate at a predetermined count.

The invention also seeks to provide a counting and stacking unit which incorporates a delivery system for receiving completed forms from the collator, and delivering them for stacking, and in which such delivery system is discontinuous, so as to define a short gap or gate, and incorporating reject means in such gap whereby faulty forms may be rejected and prevented from continuing along the delivery path.

A further object of the invention is to provide a counting and stacking unit in which the stacks of business forms are jogged in at least one direction while the forms are being placed on the stack. In some cases, the jogging may be carried out in two directions at right angles to one another.

It is a further objective of the invention to provide a counting and stacking unit in which two stacks of business forms are produced alternately one above the other at predetermined spaced apart locations, and including a run out table for delivery of completed stacks of forms, the run out table being located at a predetermined elevation, and including transfer means for receiving a said stack of forms, and transferring it to the run out table, the transfer means being moveable both in a horizontal direction, and in a vertical direction whereby one or other stacks of forms may be collected, and then moved forwardly onto the run out table.

It is also a general objective of the invention to provide a counting and stacking unit incorporating means defining a delivery path, reject means incorporated in said delivery path for rejecting faulty forms, diverting gate means in said path for diverting forms from a portion of such path to another portion of said path and further incorporating two separate stacking stations, said delivery means delivering forms to one or other of said stations, and incorporating counting means for counting forms and operating the diverting gate means, and each stacking station incorporating jogging means for jogging forms stacked at said station, and said unit further incorporating a run out table for delivery for individual stacks of said forms one after the other, and further incorporating transfer means for transmitting stacks of forms from a said stacking station to said run out table.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

IN THE DRAWINGS

DESCRIPTION OF A SPECIFIC EMBODIMENT

As has been mentioned above, the counting and stacking machine according to the invention will be used in conjunction with a collating and gluing machine. There are various forms of such machines on the market, and their description is omitted here for the sake of clarity, and in any event such collating and gluing machine forms no part of the present invention. Forms, such as business forms, of the type discussed herein are initially printed on continuous webs or rolls of paper stock. The rolled webs are then placed on a gluing and collating machine, and in conjunction with rolls of carbon paper. The gluing and collating machine will interleave the printed webs, and carbon paper in an appropriate manner, and apply glue where required. The last portion of such a gluing and collating machine comprises a pair of cutting rolls the function of which is to cut off each glued set of forms from the continuous webs. The only portion therefore of the gluing and collating machine which is shown in the present illustrations are the cutting rolls which are shown as C. The webs are shown collectively as W.

The severed form sets are shown by the reference letter F and in a typical case may comprise as many as five printed sheets of paper and a suitable number of interleaved sheets of carbon paper (if carbon paper is required). It will of course be understood that while the glues used in the manufacture of business forms are quick setting glues, the gluing and collating machines operate at a very high speed and the very brief time intervals between the gluing of the various webs and the cutting of the form set F, may not be sufficient for the glue to completely cure. Consequently, such form set F will usually require very careful handling when being stacked and counted.

Figure 1:
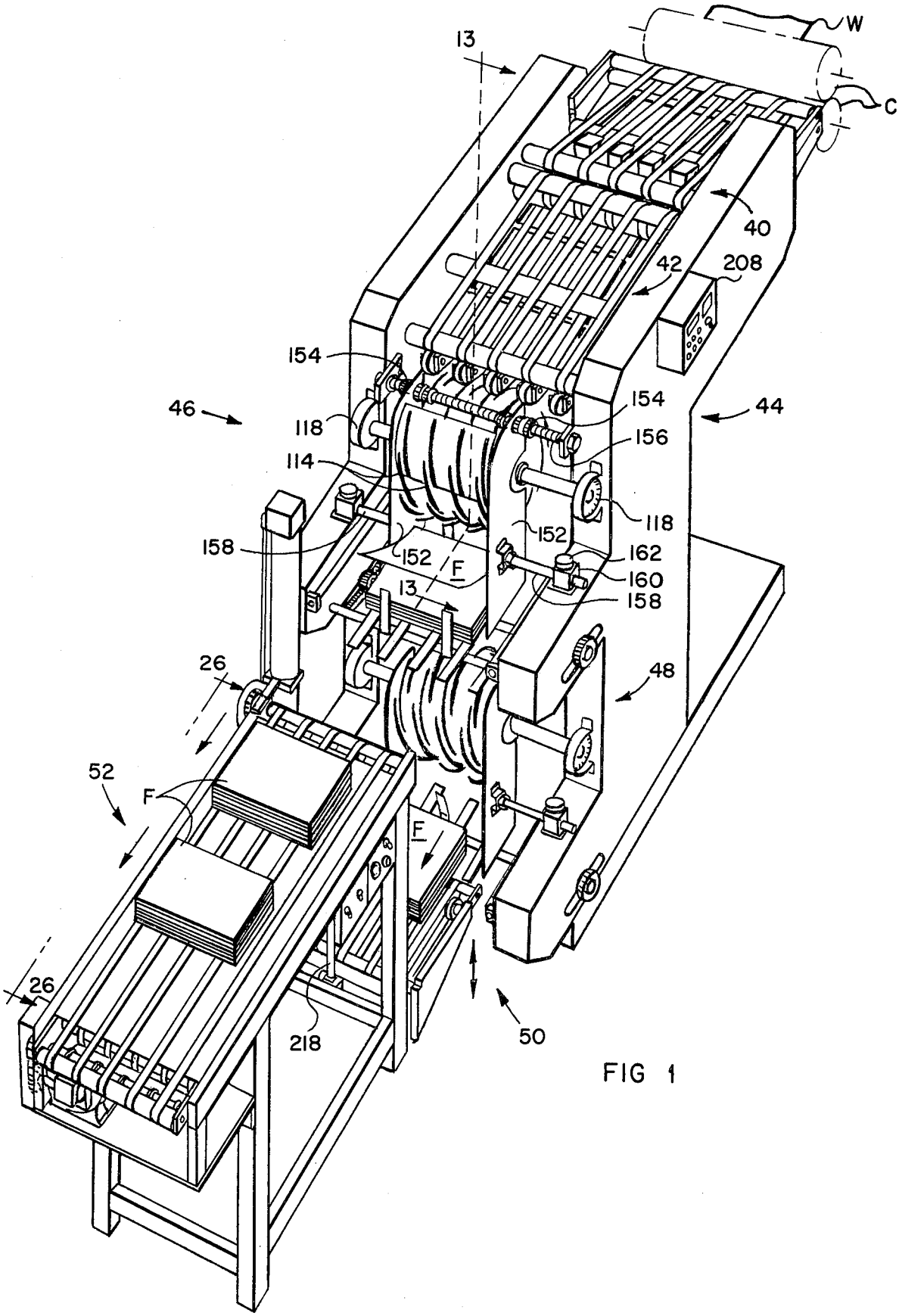
FIG. 1 is an upper perspective illustration showing the complete counting and stacking unit according to the invention.
Figure 2:
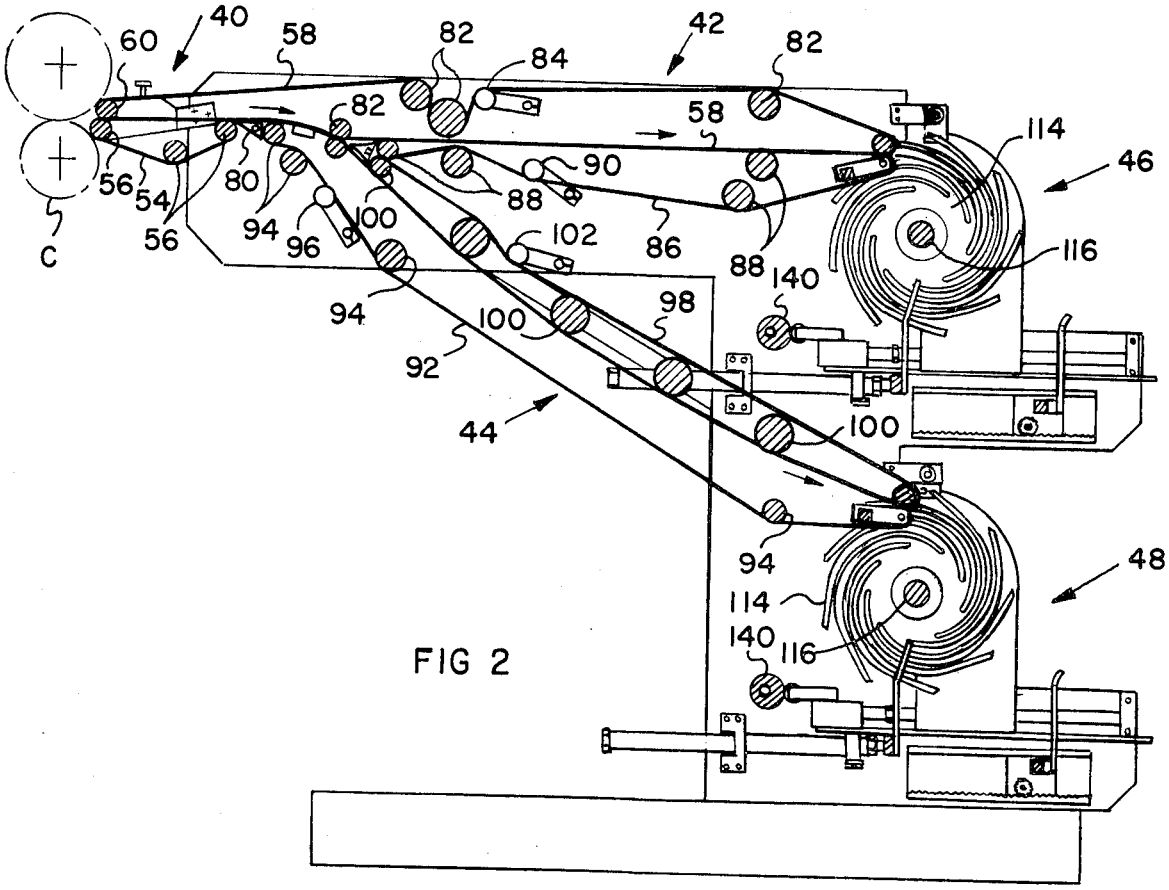
FIG. 2 is a schematic side elevational view of the delivery mechanism, viewed along the line 2—2 of FIG. 3.

Referring now to FIGS. 1 and 2, the counting and stacking unit according to the invention may be considered as a number of separate sub-assemblies namely, the pick up and reject section 40 the upper and lower delivery paths 42 and 44, the upper and lower stacking and jogging unit 46 and 48, the transfer unit 50, and the run out table 52.

Figure 3:
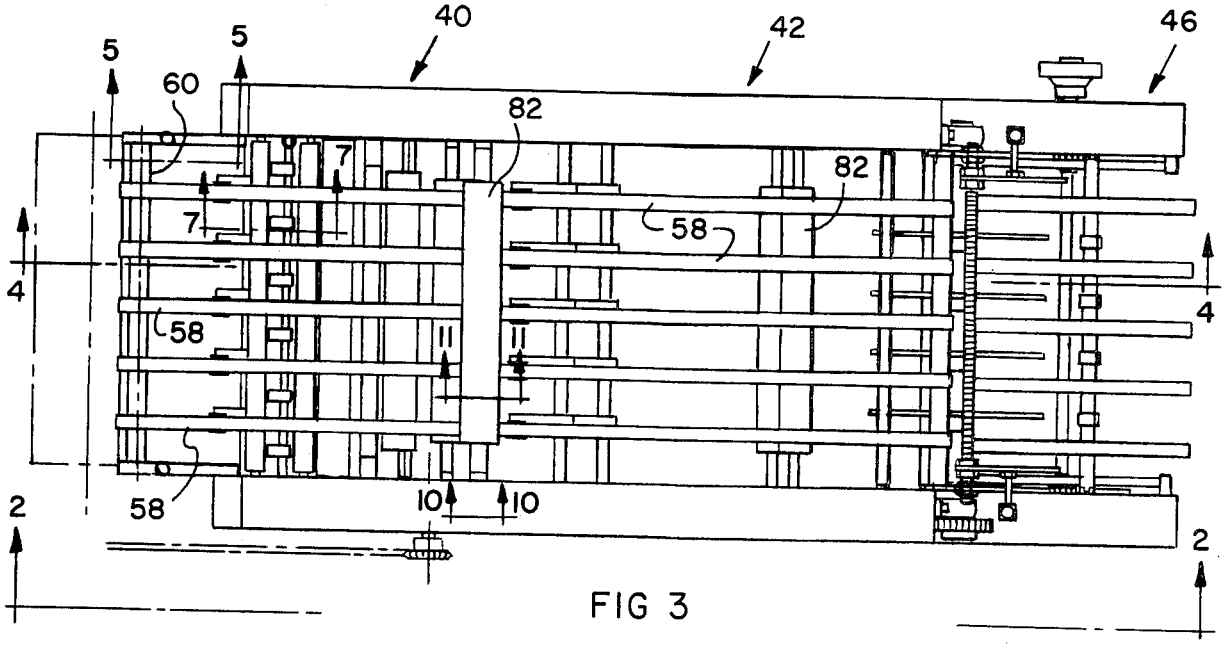
FIG. 3 is a top plan view of the delivery portion of the apparatus of FIG. 1.
Figure 4:
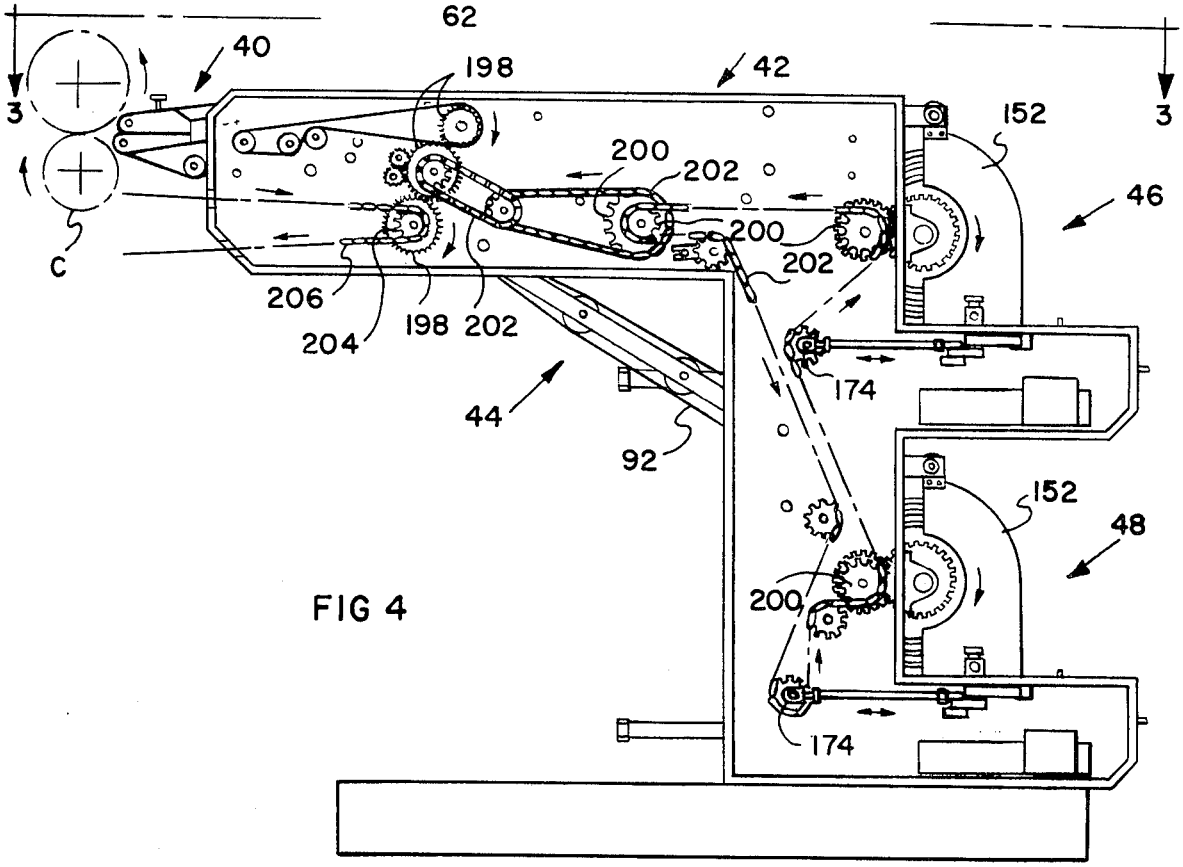
FIG. 4 is a side elevational view taken along the line 4—4 of FIG. 2, cut away to show the belt delivery paths.

Referring to FIGS. 2, 3 and 4, the pick up and reject section 40 will be seen to be comprised of lower main conveyor tapes 54 arranged to run around a set of suitable rollers 56. The pick up and delivery section further comprises upper main conveyor belts or tapes 58 running around rollers 60. It will be seen that the upper tapes 58 in fact extend from the pick up and reject section through the upper delivery path 42.

For the sake of simplicity, description of the side frames of the apparatus has been omitted. It will however be well understood that where appropriate suitable bearings, bushings or other mountings will be provided on such side frames in a manner well known in the art.

The tapes 54 and 58 forming the main conveyor are arranged to receive form sets F from the cutter C and move them through to the upper and lower delivery path 42 and 44. The tapes 54 and 58 are therefore driven in opposite directions so that they form upper and lower main conveyor belt means engaging the form sets on both sides and conveying them in the manner required.

Figure 5:
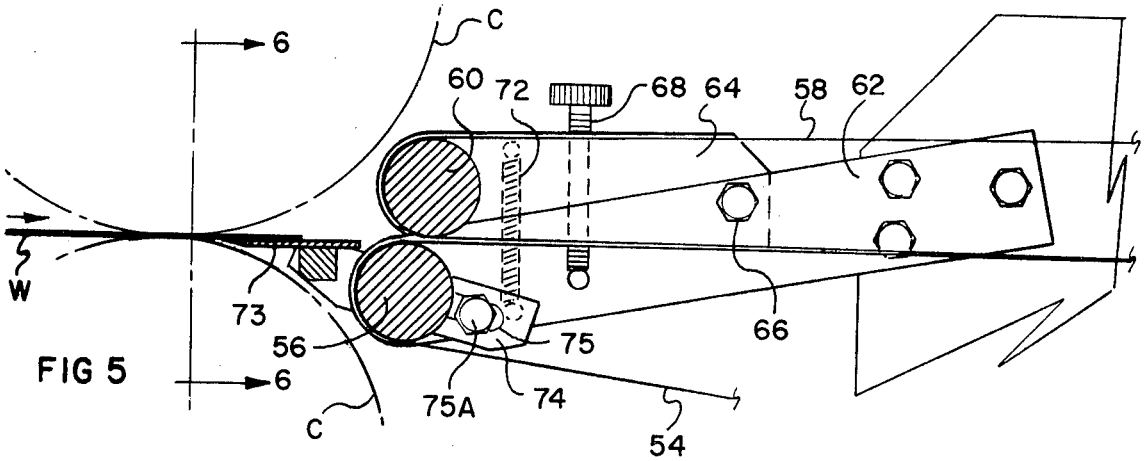
FIG. 5 is an enlarged section along the line 5—5 of FIG. 3.
Figure 6:
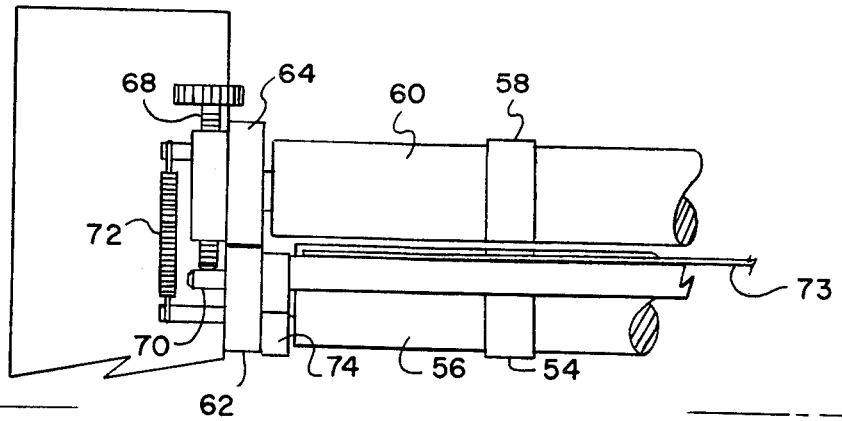
FIG. 6 is an end view along the line 6—6 of FIG. 5.

The form sets F may vary considerably in thickness due to differences in the specifications of the paper requirement, and due to the number of different layers of paper in the form sets. In addition, at this stage, the glue may not be completely cured. Consequently, it has been found desirable that the upper and lower tapes 54 and 56 should be carefully adjusted so as to apply the right amount of pressure to the form sets. For this purpose, adjustable mounting means are provided for the rollers and tapes as shown in FIG. 5 and FIG. 6. The mounting means will be seen to comprise a lower mounting arm 62, on which the lower roller 56 is mounted. The upper roller 60 is mounted on a swingable upper mounting arm 64 which is swingably attached to the lower mounting arm 62 by bolt 66.

An adjustment screw 68 extends between the upper swingable arm 64 and the lower arm 62 and permits the upper arm to be adjusted relative to the lower arm. The lower end of the screw 68 rides on an abutment 70, so that the screw 68 merely functions as an adjustable stop, leaving the upper arm 64 moveable relative to the lower arm 62 at all times.

In order to hold the two arms together, a spring 72 extends between the arms 62 and 64. In this way, the spacing between the rolls 56 and 60 may be adjusted, while permitting movement of the upper roll relative to the lower roll, against the force of the spring.

In order to guide form sets between the tapes 54 and 58, a guide plate member 73 formed of any suitable anti friction material is fitted at the free end of brackets 74, (on each side of the apparatus) and is adjustably mounted by slot 75 and bolt **75*a* to arm 62** so as to place it adjacent to the cutters C.

Figure 7:
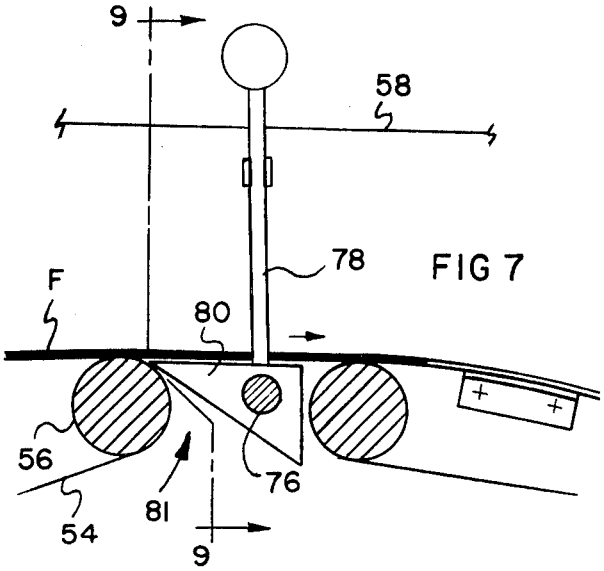
FIG. 7 is an enlarged section along the line 7—7 of FIG. 3 showing the reject mechanism.
Figure 8:
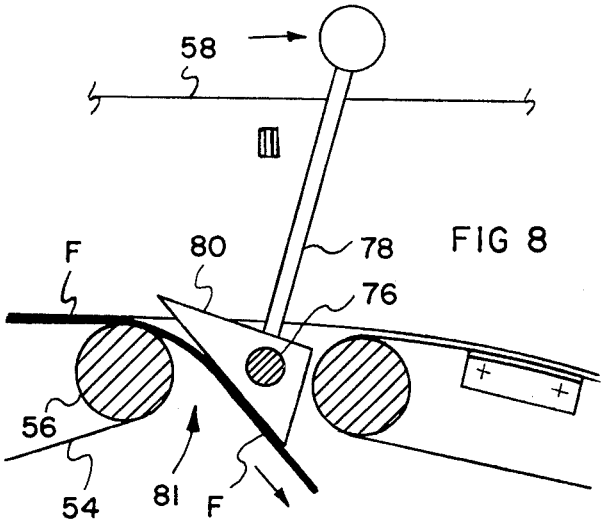
FIG. 8 is a side elevational view corresponding to FIG. 7 showing the reject mechanism in a different position.
Figure 9:
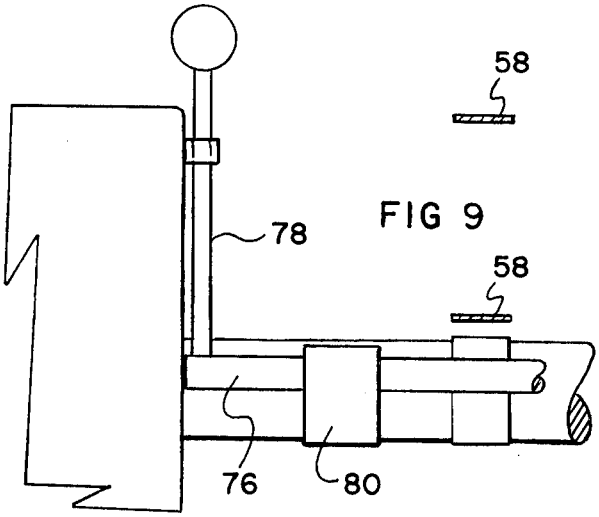
FIG. 9 is an end elevational section along the line 9—9 of FIG. 7 showing another view of the reject mechanism.

The reject portion of the mechanism is shown more clearly in FIGS. 7, 8 and 9. It will be seen to comprise a transverse shaft 76 extending parallel to the last of the rollers 56, and connected to an operating arm 78 extending upwardly therefrom at right angles. The shaft 76 is rotatable to and fro by movement of the arm 78.

At spaced intervals along the shaft 56 there are provided a series of generally wedge-shaped deflector members 80. The deflector members 80 are swingable between upper and lower positions as shown in FIGS. 7 and 8. In their lower positions a form set may pass over the top of the deflector members 80. In their upper positions the form sets will be intercepted by the deflector members 80 and directed downwardly through the gap or gate 81 as shown in FIG. 8.

Referring now to FIGS. 2, 3 and 4 the upper and lower delivery paths 42 and 44 are constructed in a manner essentially similar to that of the belts or tapes of the pick up and reject section 40. The upper delivery path 42 comprises a continuation of the group of conveyor tapes 58, from the main conveyor portion, which, in the region of pick up and reject section run around the rollers 60.

In the region of the upper or first branch path 42, such tapes 58 are continued and run around rollers 82, and are tensioned by means of the movable tension rollers 84. The lower portion of the first branch path or conveyor comprises tapes 86 running around rollers 88, and tensioned by rollers 90. The tapes 58 and 86 are driven in opposite directions by suitable drive means described below so as to engage the form set F on both sides and conveying them along the upper delivery path 42.

The lower or second branch path 44 comprises a set of lower tapes 92 running around rollers 94 and tensioned by a tension roller 96. It will be seen that the conveyor tapes 92 run from a point just down stream of the gate 81, and for a short distance thereafter they run in close contact with the main conveyor tapes 58.

In this region therefore the conveyor tapes 92 may be considered as a portion of the main conveyor. The lower or second branch path 44 is further constituted by a set of upper conveyor tapes 98 running around rollers 100 and tensioned by rollers 102. The tapes 98 run in opposite direction to the tapes 92, and are arranged so as to contact the upper sides of the form sets F, and are driven by drive means described below.

Figure 10:
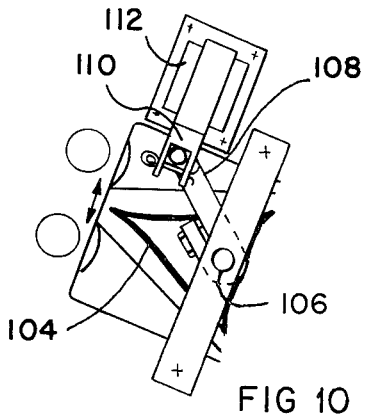
FIG. 10 is a side elevational view taken along the line 10—10 of FIG. 3 showing the diverting gate mechanism.
Figure 11:
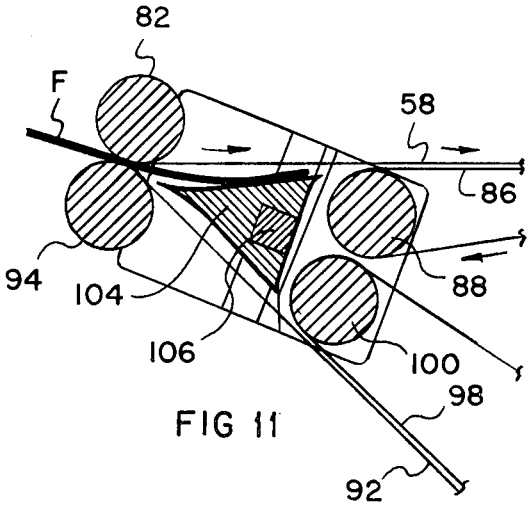
FIG. 11 is a section along the line 11—11 of FIG. 3 showing the details of the diverting gate as shown in FIG. 10.
Figure 12:
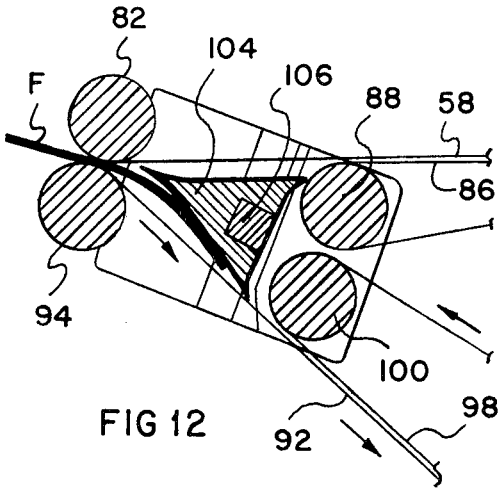
FIG. 12 is a sectional view corresponding to FIG. 11 showing the parts in another position.

In order to direct the form sets F into either the upper first branch path 42 or the lower second branch path 44, diverting gate means are provided as best shown in FIGS. 10, 11 and 12. Such gate means will be seen to comprise a plurality of generally triangular shaped director members 104 mounted spaced apart from one another along a shaft 106. The shaft is journaled on opposite sides of the apparatus so that it may be swung through a small arc, as shown in FIGS. 11 and 12. It is operated by means of an operating arm 108, the opposite end of which is operatively connected to the armature 110 of a solenoid 112. The solenoid 112 will be operated automatically in response to signals generated in response to a count of form sets in a manner to be described.

When the director members 104 are in their lower position as shown in FIG. 11, then the form sets F will be directed into the upper delivery path 42. When the director members 104 are operated so as to lie in their upper position as shown in FIG. 12 the form sets F will be diverted downwardly into the lower delivery path 44.

At the down stream end of the two delivery paths 42 and 44 there are provided the two stacking and jogging units 46 and 48. Both such stacking and jogging units are of the same construction. Accordingly only the upper or first stacking unit 44 will be described. It will however be appreciated that the same description is applicable to the lower or second stacking and jogging unit 48.

Figure 13:
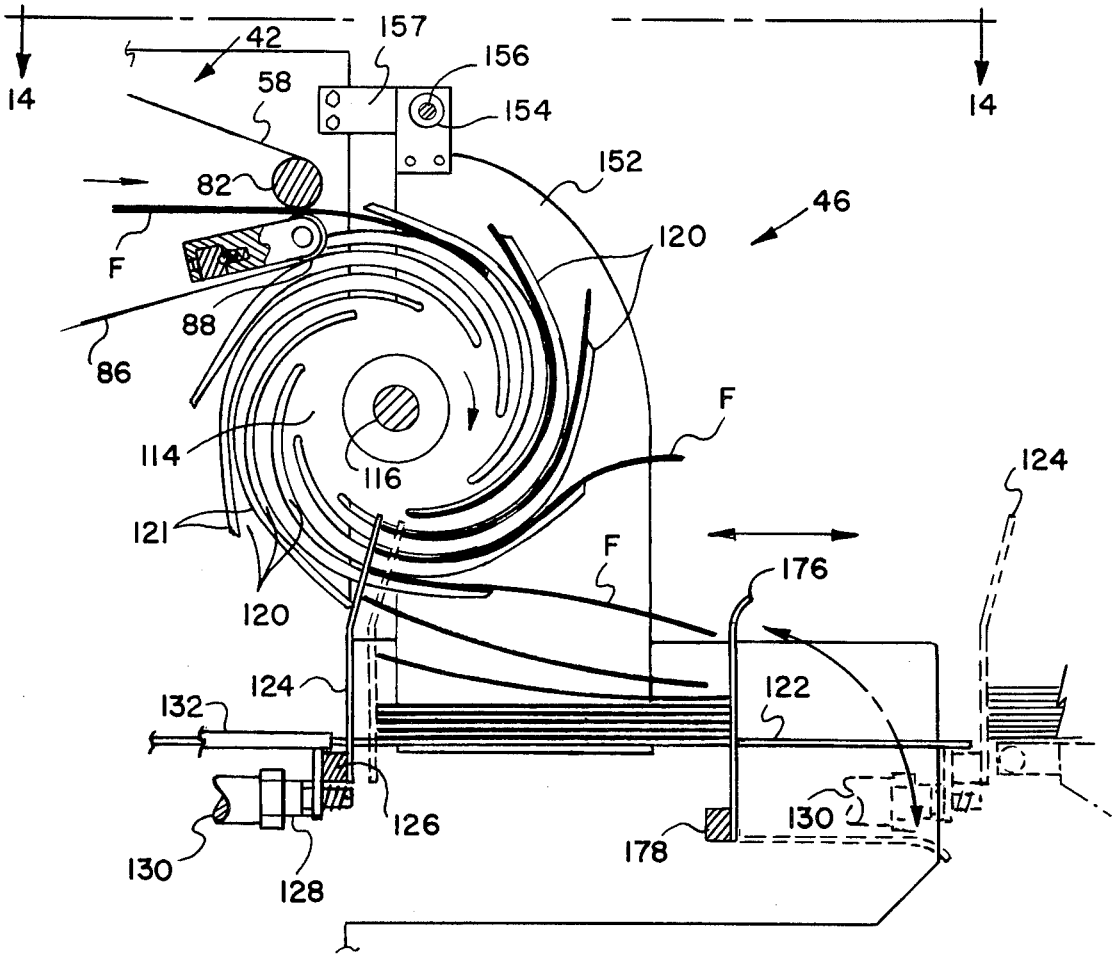
FIG. 13 is an enlarged side elevational view along the line 13—13 of FIG. 1 showing one of the stacking units.
Figure 17:
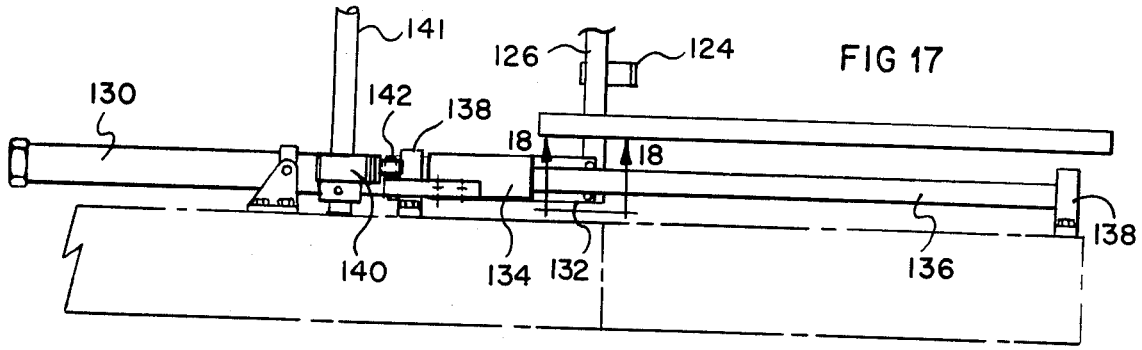
FIG. 17 is a top plan view along the line 17—17 of FIG. 15.

Referring now to FIGS. 1 and 13, it will be seen that the stacking and jogging unit 46 comprises a plurality of stacking discs 114 mounted spaced apart from one another along a shaft 116, which is journaled on opposite sides of the apparatus as at 118.

Each of the discs 114 is provided with a plurality of curved slots 120 defined by fingers 121 being adapted to receive one of the form sets F in the manner shown in FIG. 13. The discs 114 are keyed on the shaft 116 by any suitable means (not shown) so that the slots 120 of the adjacent discs 114 along the shaft are all aligned with one another. Furthermore, the drive means (not shown) to the shafts 116 is timed so that one of the slots 120 will register with the tapes 58 and 86 of the upper delivery path 42 so as to be oriented to receive a form set F as it is delivered therefrom.

In order to discharge the form sets F from slots 120 in the discs 114, and deposit them in a horizontal fashion in a stack, a plurality of horizontal receiving bars 122 are provided beneath the discs 114 and extending forwardly therefrom. A pair of discharge arms 124 are mounted beneath the receiving bars 122, and extend upwardly therefrom in a plane located just rearwardly of the axis of the shaft 116. Preferably, the upper portions of the arms 124 are angled slightly forwardly. The arms 124 are long enough so as to intercept form sets F lying in the slots 120, and as the discs 114 rotate the form sets F are thereby discharged from the slots 120, in an essentially horizontal manner, and will fall one on top of the other on the receiving bars 122.

The discharge arms 124 are mounted at their lower ends on a cross bar 126 which is in turn connected to the operating rod 128 of a suitable pneumatic cylinder 130 (see FIGS. 15-18). The cylinder 130, which may well be any other form of motive power, may be operated to extend and retract the rod 128, thereby moving the arms 124 forwardly and rearwardly along the path shown in FIG. 13 in phantom, for discharging a completed stack of form sets F from the bars 122.

In order to provide a jogging action for the stack of form sets F, any suitable jogging means may be provided of which a variety are available in the art. In the present embodiment of the invention, a portion of the jogging action is in fact provided by the discharge arms 124 themselves. This however is not a critical feature of the invention. The jogging action could equally well be provided by some other form of arms similar to the arms 124 and in fact in certain circumstances especially for still higher speed operation, this modification might even be preferred to the form of the invention as shown. In the present embodiment however, the cross bar 126 carrying the arms 124, is connected by means of a plate 132 to a sliding bearing 134, sliding on a guide shaft 136. The shaft 136 is mounted at each end in fixed relation as by the mounting brackets 138, and is oriented to lie parallel to but spaced from the rod 128 of the cylinder 130.

Figure 15:
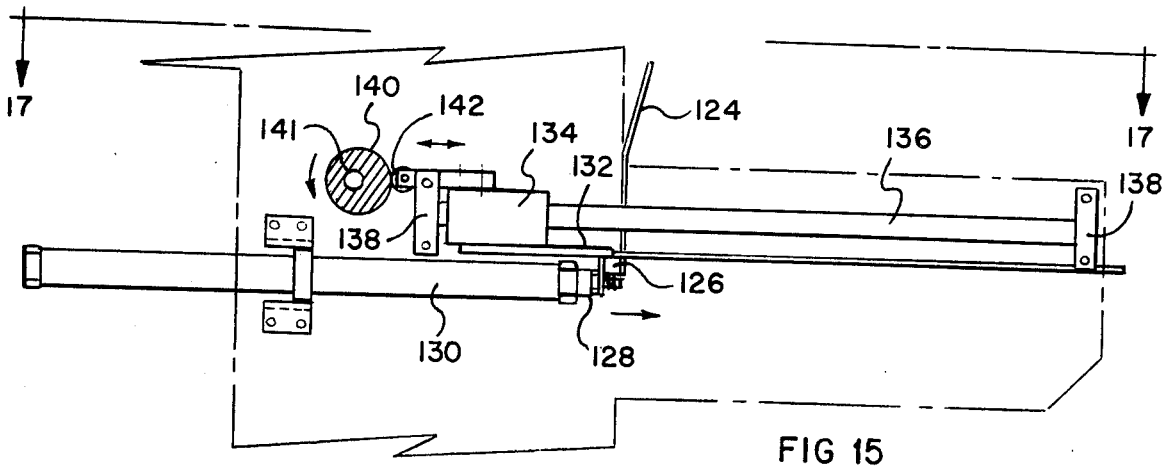
FIG. 15 is a side elevational view showing the details of the jogger unit incorporated in the stacking station of FIGS. 13 and 14.
Figure 16:
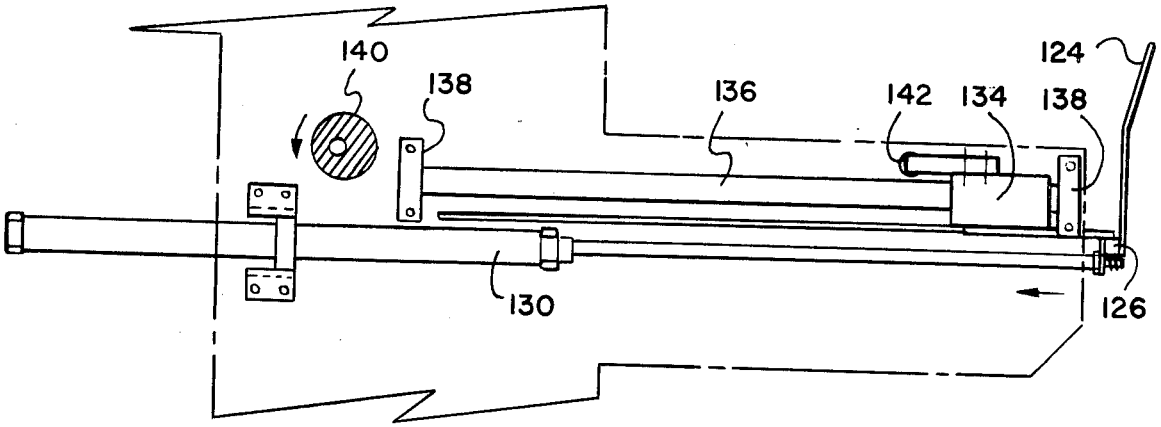
FIG. 16 is a side elevational view of the details corresponding to the jogging unit of FIG. 15 shown in a different position.
Figure 18:
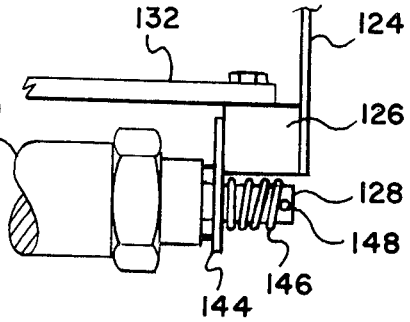
FIG. 18 is a greatly enlarged side elevational view of a detail of FIG. 17 shown along the line 18—18.

At the rearward end of the shaft 136, there is provided a jogging cam 140, carried on drive shaft 141 or driven by any other suitable means. The cam 140 is oriented so as to engage a roller 142 mounted on the rearward end of bearing sleeve 134 when the rod 128 of the cylinder 130 is in its rearward position as shown in FIGS. 15 and 16. Cam 140 will be rotated continuously so that the roller 142 transmits a series of repetitive movements to the bearings 134 which are thereby transmitted to the discharge arms 124, and provide a jogging action.

In order to permit the cross bar 126 and discharge arms 124 to move to and fro in response to the cam, the piston rod 128 of the cylinder 130 extends through a plate 144 (see FIG. 18) connected to cross bar 126, and is provided with a spring 146 retained on the rod 128 by means of the pin 148. In this way, the cross bar 126 then may move forwardly in response to movement from the cam 140, and will return again in response to the action of the spring 146.

Figure 14:
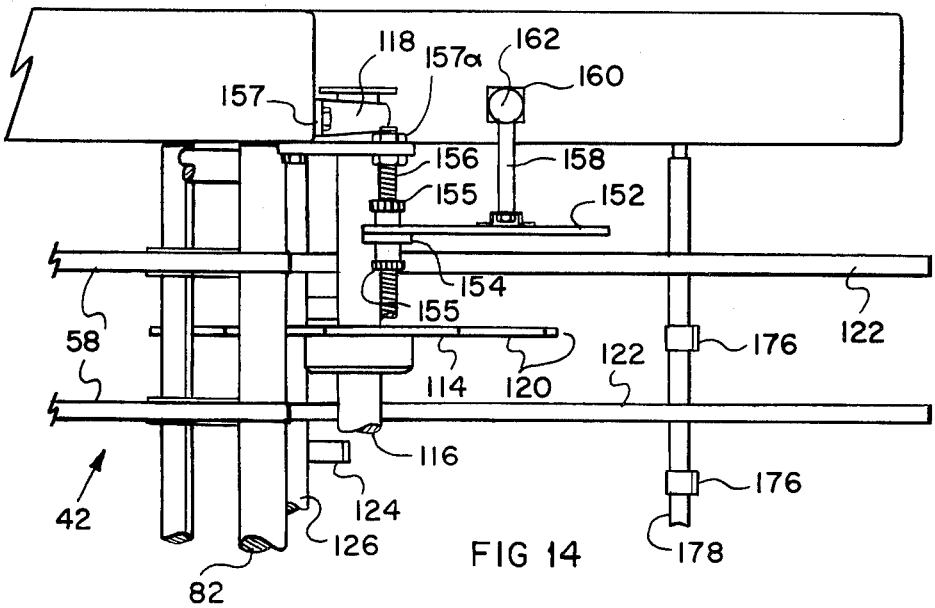
FIG. 14 is a top plan view along the line 14—14 of FIG. 13.

In order to guide and control the side edges of the form sets F, a pair of side guide plates 152 are provided, being supported on their upper ends by adjustable support bearings 154 mounted on the threaded cross shaft 156 and being adjustable therealong by nuts 155. The bearings 154 are arranged in such a manner that the guide plates 152 may slide to and fro relative to the bearings 154 (see FIGS. 13 and 14). Shaft 156 is secured at its ends in brackets 157 by nuts 157*a*.

On their outer sides, the guide plates 152 are also supported by means of the stub shafts 158 extending outwardly therefrom, and passing through supporting blocks 160. Stub shafts 158 may be adjusted by sliding to and fro through the blocks 160, and may be fastened at the appropriate width by means of the hand screws 162.

Figure 20:
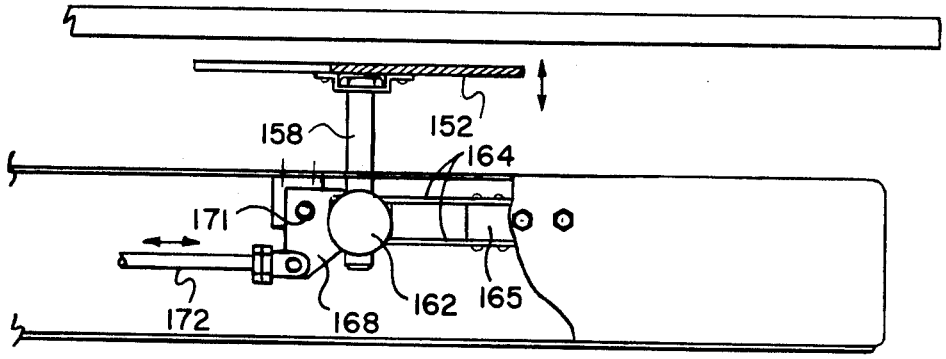
FIG. 20 is a top plan partially sectioned along the line 20—20 of FIG. 19.
Figure 21:
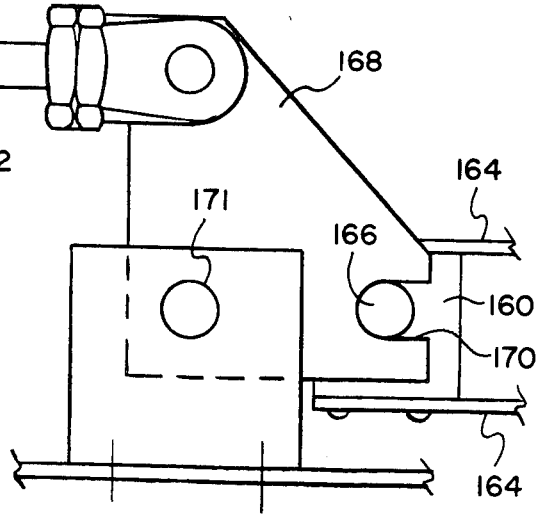
FIG. 21 is an enlarged detail of a portion of FIG. 19 shown along the line 21—21.
Figure 19:
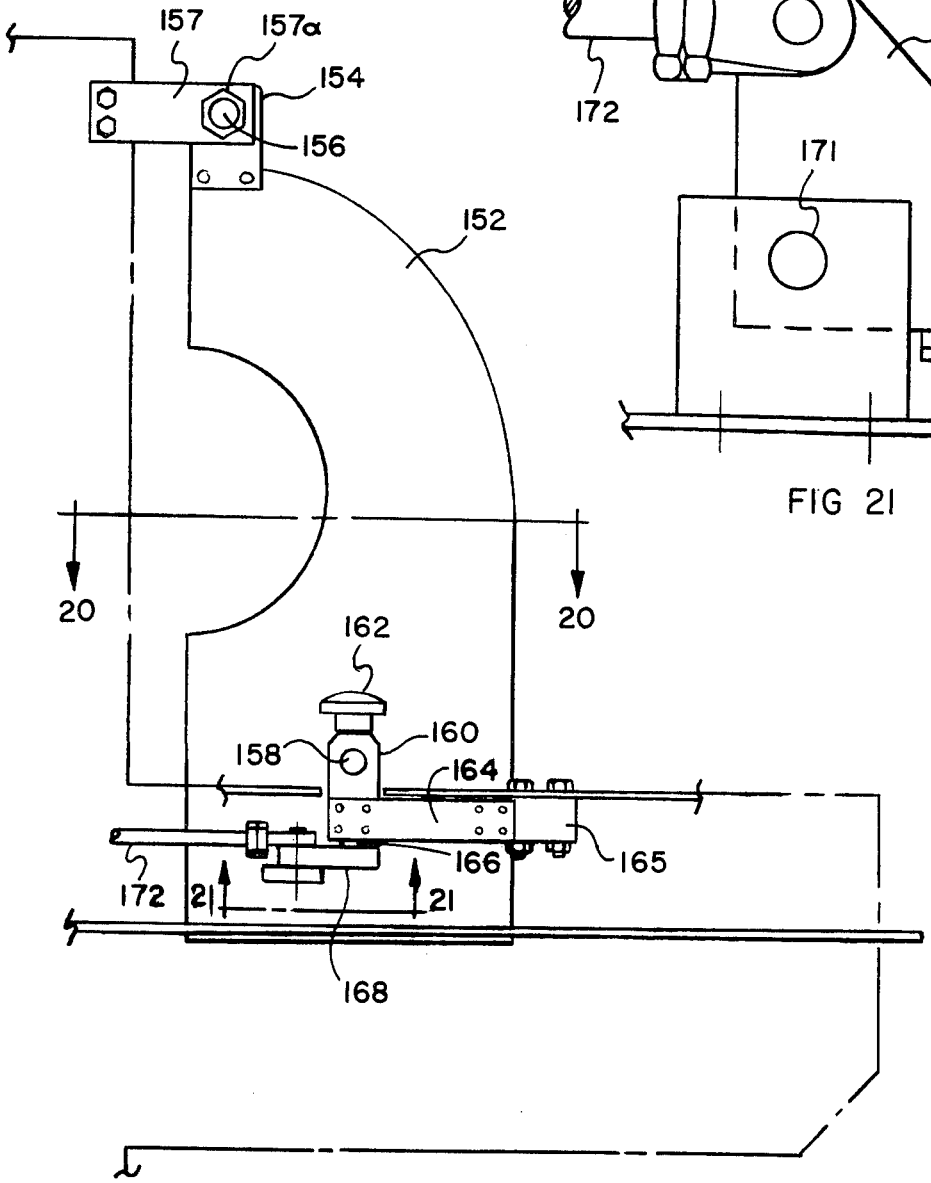
FIG. 19 is a section along the line 19—19 of FIG. 14 showing details of the side jogging portion of the stacking unit.
Figure 22:
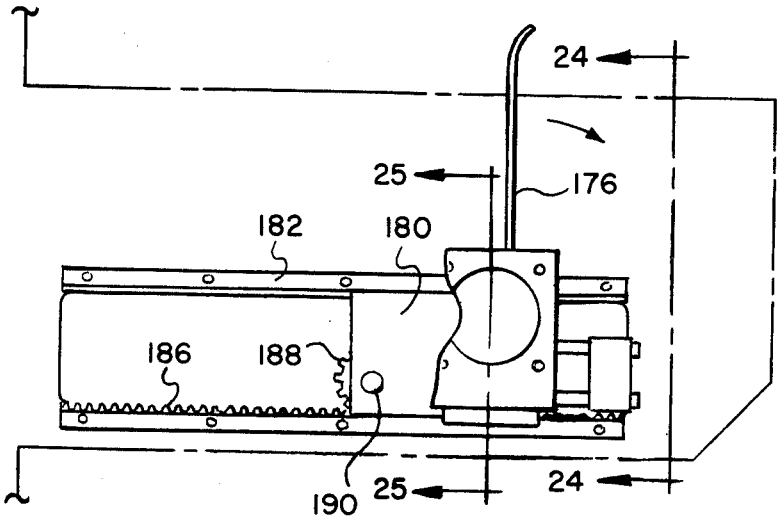
FIG. 22 is an enlarged side elevational view, partially sectioned and cut away, of the detail shown circled as 22 in FIG. 4.

In this preferred embodiment of the invention, a side jogging action is also performed by one each of the guide plates 152 at each stacking unit. This side jogging action is imparted to the guide plates 152 through the mounting blocks 160. The mounting blocks 160 are mounted between a pair of leaf springs 164 (see FIGS. 19, 20 and 21), the other end of which are fastened in position to any suitable fixed side portion 165 of the apparatus. An actuating pin 166 extends downwardly from the block 160 and engages a bell crank 168 having a slotted opening 170 formed therein for receiving the pin 166. The bell crank 168 is itself swingably mounted on pivot pin 171, and is operated by means of operating rod 172 extending from any suitable power source on to the drive train of the apparatus. Cyclical operation of the rod 172 will cause the bell crank 168 to swing to and fro thereby moving the pin 166 from side to side, and thereby imparting a jogging action to the plate 152.

In order to further guide and control the formation of a stack of forms set F, there are provided the forward guide arms 176 (see FIGS. 22 to 25). The guide arm 176 are mounted on a cross shaft 178 extending from side to side in the machine. The entire cross shaft 178 and arms 176 are moveable forwardly and rearwardly so as to permit the adjustment of the position of the arms 176 for different sizes of form sets F. Such forward and rearward movement is provided by means of a pair of slideable bearing plates 180 retained at their upper ends by means of flanges 182. The lower ends of the plates 180 are supported on the rib members 184. The plates 180 are slid to and fro by means of a rack 186 and gear 188 located on either side of the apparatus. The gears 188 are mounted on a shaft 190 rotated by a hand wheel 192. In this way the position of the arms 176 may be adjusted to and fro dependent upon the size of the form sets F.

Figure 23:
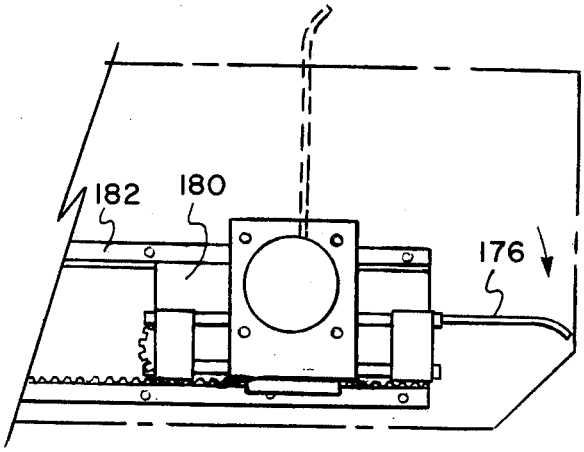
FIG. 23 is a side elevational view partially cut away showing the detail of FIG. 22 in a different position.
Figure 25:
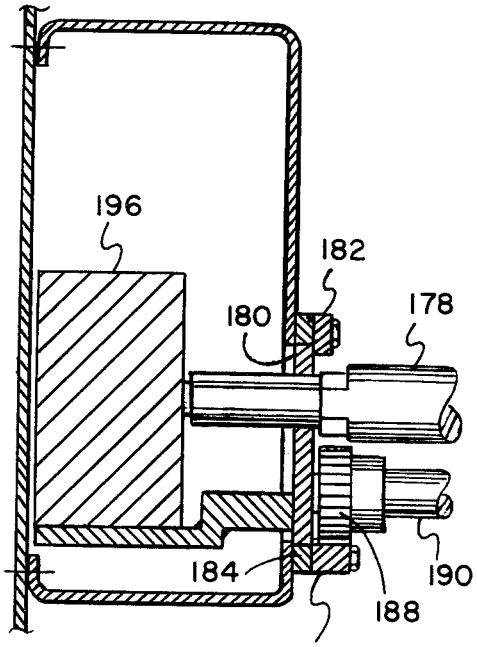
FIG. 25 is a section along the line 25—25 of FIG. 22.
Figure 24:
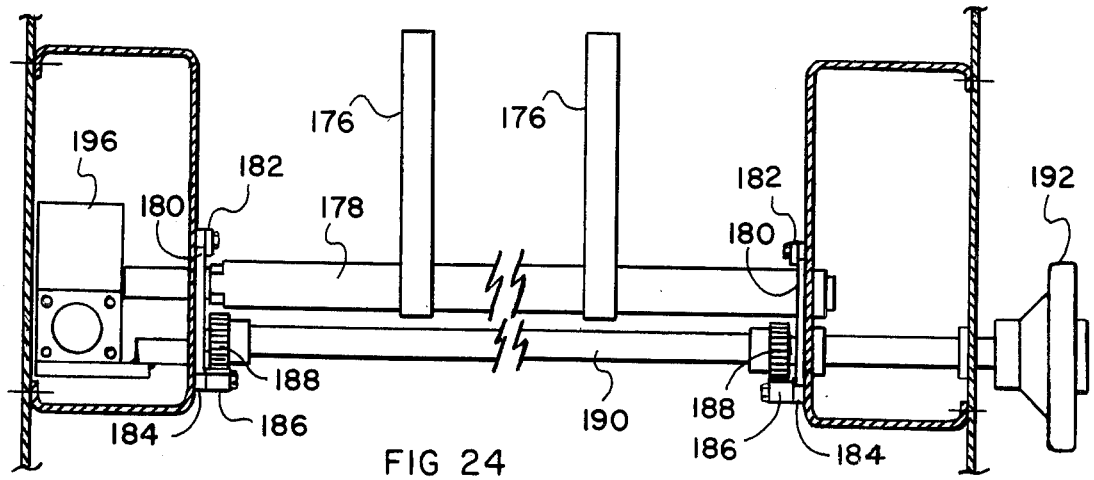
FIG. 24 is a section along the line 24—24 of FIG. 22.
Figure 27:
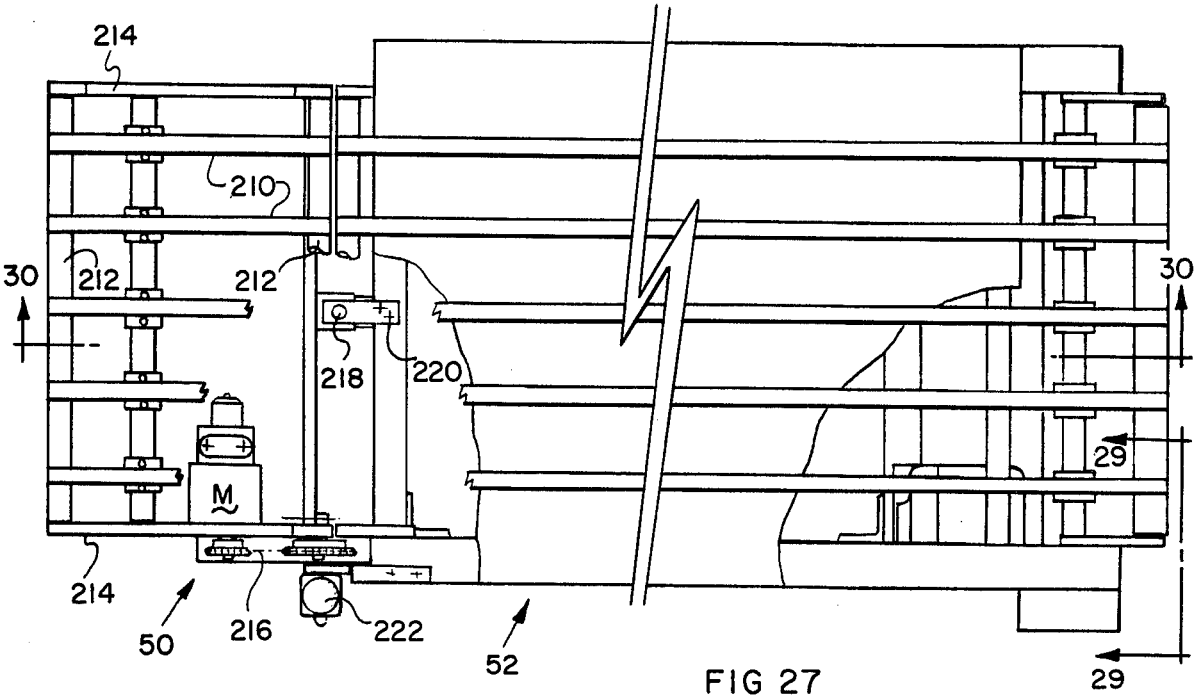
FIG. 27 is a top plan view taken along the line 27—27 of FIG. 26.
Figure 26:
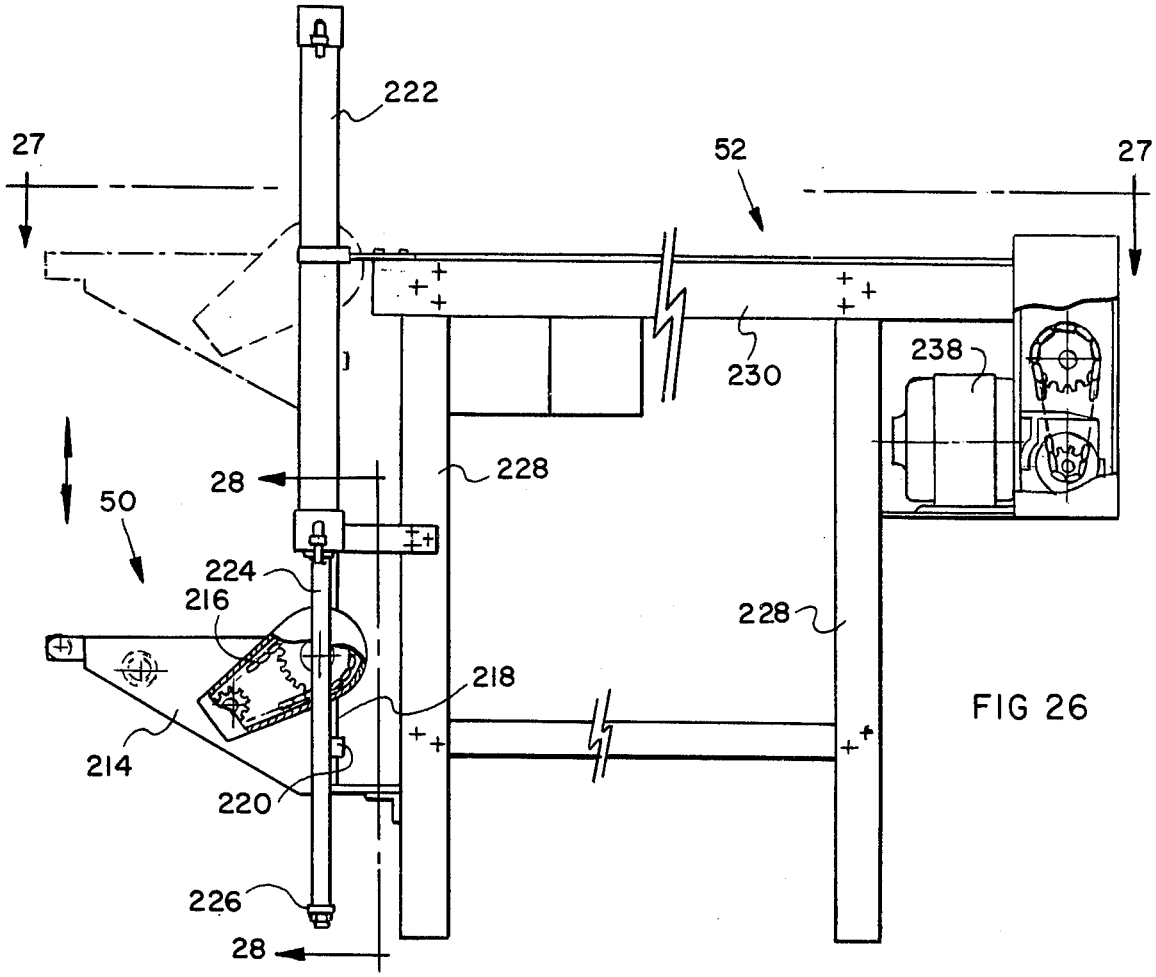
FIG. 26 is a side elevational view, partially cut away, along the line 26—26 of FIG. 1.

The arms are swingable downwardly and out of the way, so that a completed stack of form sets F may be discharged from the support bars 122. For this purpose any suitable rotary actuator 196 is provided to rotate the shaft 178. Rotation of the shaft 178 swings the arms 176 downwardly and upwardly as shown in FIG. 23. The actuator 196 may be pneumatic, electric, or any other suitable system, driven in timed relation so as to operate arms 176 when the stack is completed and ready for discharge.

Referring now to FIG. 4, the drive means for driving the various conveyor tapes, rollers, and stacking units will be seen to comprise a series of gears 198, sprockets 200, and drive chains 202.

The precise details of the means whereby the conveyor tapes are driven by suitable drive rollers or pulleys is omitted for the sake of clarity. Such drive systems are well known in the art and require no further description.

The motive power for driving such drive train comprises the sprocket 204 and chain 206. The chain 206 is driven by a sprocket (not shown) located on the collator. Obviously however a separate power source could be used if desired. The timing of the operation of the conveyor tapes and stacking wheels is of course of considerable importance to the invention, and in accordance with well known engineering techniques, it is necessary to select appropriate gear and sprocket ratios for the purpose.

In principle however the entire drive train must be operated at a speed which bears a certain relation to the speed of operation of the collector. Clearly, the gluing and collating unit may be run over a relatively wide range of speeds since it is operating with web material. The end product, which is delivered from the cutting rolls C is however a series of separate form sets F. It will therefore be apparent that the speed of operation of the stacking apparatus according to the invention must necessarily be related to the speed of operation of the gluing and collating apparatus that is to say the speed at which the form sets F are delivered from the cutting wheels C. It will of course be appreciated that it would be possible to place a timing mechanism on the gluing and collating apparatus, for example on the cutting rolls C themselves, and count the number of revolutions of the cutting rolls C. This would give a count of the number of form sets F being delivered from such gluing and collating apparatus. This count could then be used to control the speed of operation of the counting and stacking apparatus according to the invention. In practice however this is unnecessarily complicated, and it is found simpler to link the drive of the counting and stacking apparatus directly to the drive of the gluing and collating apparatus by means such as chain 206.

It will also be appreciated that the form sets F as they are delivered from the cutting rolls C are closely spaced together with one another. In fact, since they are cut off one at a time from a continuous web of material, they will be separated only by about the thickness of the incision made by the cutting rolls C. Such a close spacing makes it difficult to handle the form sets F in the stacking units 46 and 48 since they will arrive there virtually with no spacing between them whatever, and it will be extremely difficult to introduce them one at a time into the slots 120.

Accordingly, the operation of the conveyor tapes in the pick up and reject section 40, and in the upper and lower delivery sections 42 and 44, is such that it increases the speed of the form sets F by a predetermined factor, e.g., about 25 percent. In this way, as soon as a form set F is grasped by the tapes 54 and 58 of the pick up and reject section 40, it will be accelerated away from the cutting rolls C thereby leaving a gap between it and the leading end of the next form set F. This speed differential is designed into the gear ratios of the drive train as shown in FIG. 4 so that, as the gluing and collating apparatus is speeded up progressively the speed of operation of the counting and stacking unit according to the invention is also increased, thereby maintaining the speed differential desired.

In order to provide stacks of form sets F of a predetermined count, any suitable counting mechanism may be used such as that shown generally as 208 (FIG. 1). Such a counter will normally be operated by electrical pulses generated in any known manner from a suitable sensing means (not shown) connected with any one of the driven shafts, and will be arranged to provide a suitable readout giving a numerical count of the form sets F. Such a counter will preferably be of the type which may be present to deliver a signal at a predetermined count, which may be varied as desired, such a signal indicating the passage of a preset count of forms past the sensor resulting in the completion of a stack of form sets F at one of the stacking units. Such a signal will then be used to activate the solenoid 112, thereby moving the director means 104 so as to divert the form sets F from one delivery path to the other.

Similarly, the signal from the counter 208 will also be used to activate the cylinder 130 at the stacking station when the stack has been completed. The piston rod 128 will then be extended into the position shown in FIG. 17. The arm 124 will thus push the completed stack of form sets F along the support bars 122. Simultaneously, the signal from the counter 208 will also activate the actuator 196. This will procure rotation of the shaft 178 and cause the arms 176 to swing forwardly and downwardly into the position shown in FIG. 23.

Referring now to FIGS. 27 to 31, the transfer unit 50 run out table 52 are described in detail.

It will be understood that the stacking units 46 and 48 will assemble completed stacks alternately, and the completed stacks will be located at the two different levels as shown. In order to collect and transfer a stack from one level or the other, the transfer unit 50 is provided. This comprises a plurality of conveyor tapes 210 running around rollers 212 mounted between side frames 214. The tapes are driven around the rollers by any suitable drive mechanism such as the motor M, and chain 216. The side frames 214 are mounted for vertical movement on a guide rail 218 by means of a sleeve member 220. The guide rail 218 is in turn mounted on a portion of the run out table 52, to be described below.

Vertical movement of the side frames 214 is achieved by any suitable power operated means, such as the cylinder 222 fastened to the run out table 52, and having an operating rod 224 connected at its free end by means of a plate 226 to one of the side frames 214.

The operation of the motor M, and the cylinder 222 is controlled by any suitable timing mechanism connected with the counter 208. By suitable timing controls, the transfer unit 50 can be positioned so that it registers with a completed stack of form sets F either at the upper stacking unit 46 or the lower stacking unit 48 in timed relationship to the completion of the stacks F.

The operation of the cylinders 130 pushing the stacks away from the stacking units will also take place in similar timed relation so that the completed stack F is ejected from the stacking unit directly onto the tapes 210 of the delivery unit 50.

The run out table 52 is designed to permit accumulation of two or three completed stacks of form sets so that they may be packaged by an operator standing adjacent to the table 52. For this purpose, the table 52 comprises four legs 228 supporting an upper framework 230. The framework 230 supports a generally flat planar table surface 232. In order to move the stacks of forms along the table surface 232 there are provided a series of conveyor tapes 234 running around rollers 236 and over the table surface 232 and driven by any suitable means such as the motor 238.

The guide rail 218 of the delivery unit 50 is attached vertically at one end of the table 52, on suitable cross bars 240 running between framework 230.

The motor 238 is operated continuously at a relatively slow speed so as to gradually move the stacks F along the table from one end to the other, thereby permitting an operator time to arrange the stacks F in suitable packaging, while always leaving a free space at one end of the table 52 for reception of another completed stack of forms.

Figure 31:
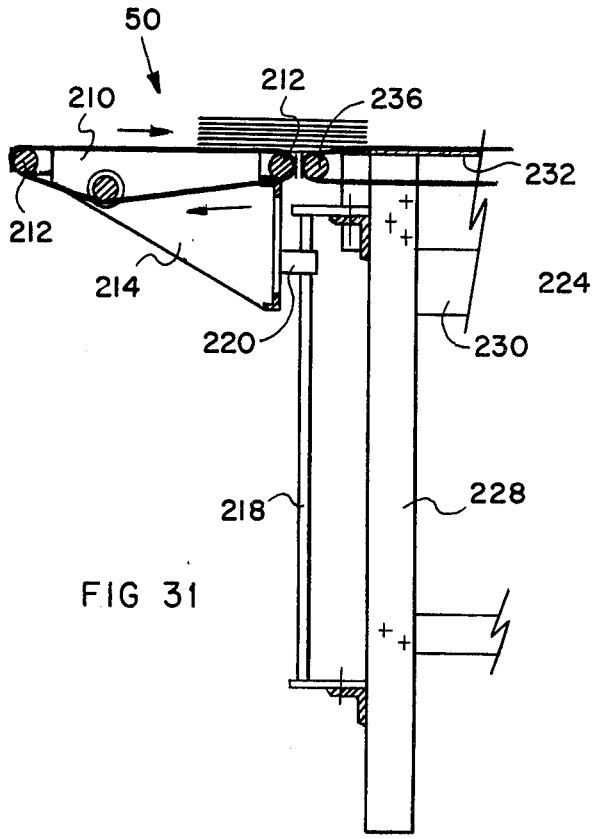
Figure 28:
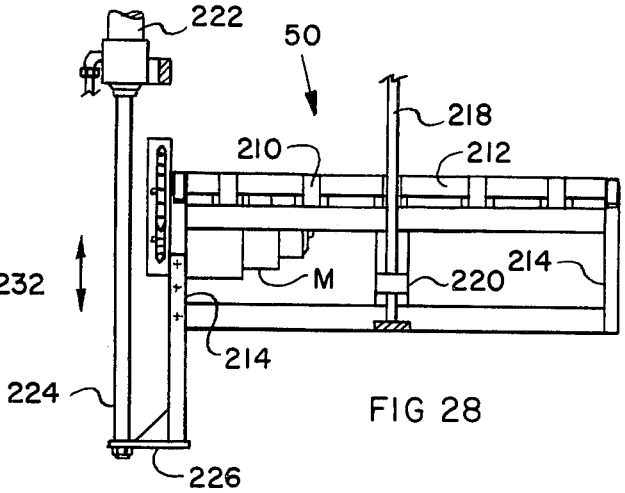
FIG. 28 is a section along the line 28—28 of FIG. 26.
Figure 29:
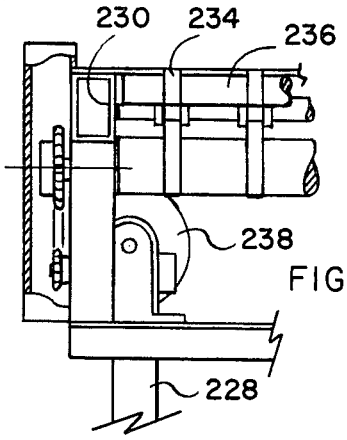
FIG. 29 is an end elevation taken along the line 29—29 of FIG. 27.
Figure 30:
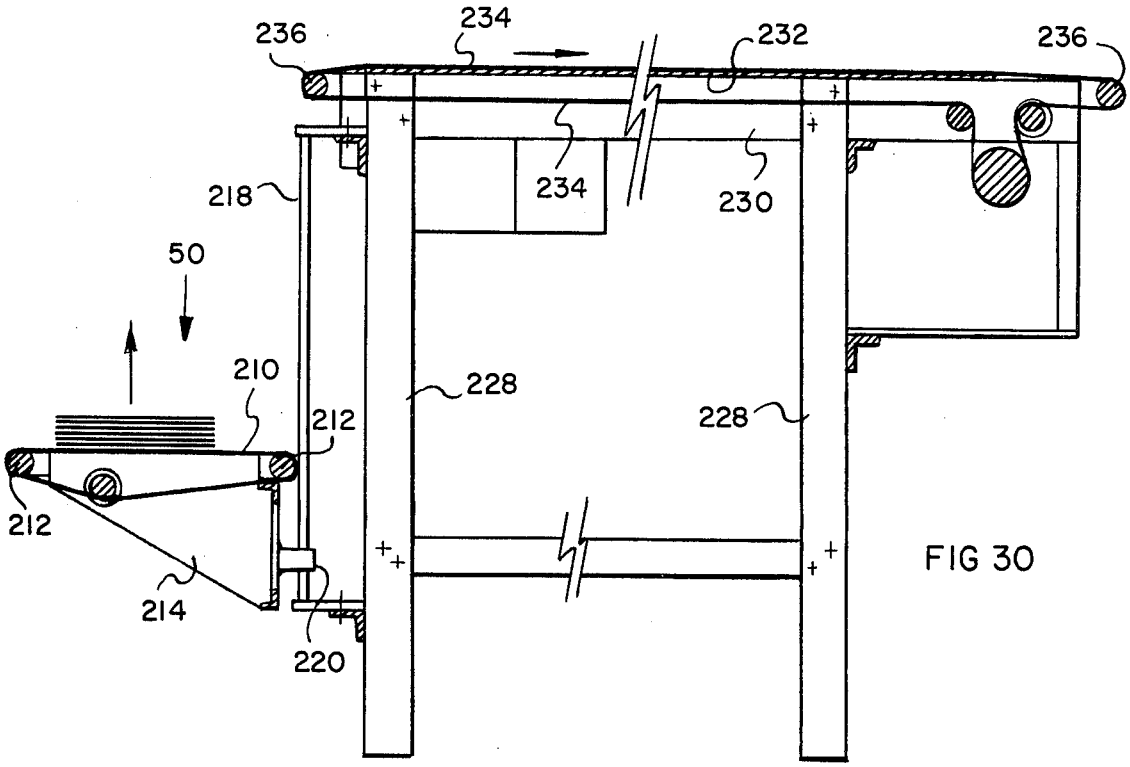
FIG. 30 is a sectional side elevational view along the line 30—30 of FIG. 27, and, FIG. 31 is a view of a portion of section of FIG. 30 showing it in an alternate position.

The operation of delivery unit 50 and its tapes 210 is such that the tapes 210 will be operated only intermittently that is to say when the delivery unit 50 is in its upper position as shown in FIG. 31, with the tapes 210 aligned substantially in the same plane as the tapes 234 of the table 52. In this way, stacks of forms F may be compiled either at the upper or the lower stacking unit 46 or 48 alternately, and, as soon as a stack is completed it will then be ejected onto the delivery unit 50 which by that time is at the appropriate height. Assuming the stack is being delivered from the upper stacking unit 46, and the upper stacking unit 46 is located at the same height as the table 52, then as soon as the stack F is ejected onto the delivery unit 50, the tapes 210 will be operated so as to deliver the stacks directly onto the table 52.

On the other hand, where the stack is formed at a different location as for example the lower stacking unit 48 (or if the upper stacking unit 46 is at a different height from the table 52 for example) then the stack of forms will first of all be ejected onto the delivery unit 50. The delivery unit 50 will then be elevated to the same level as the table 52. The tapes 210 will then be operated to drive the stack onto the table 52, where the tapes 234 will then take over and move the stacks along the table.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Apparatus for the counting and stacking of sets of forms such as business forms, having a plurality of sheets of paper, bonded together along one or more edges to provide a form set, said bonded form sets being supplied to said counting and stacking apparatus, said counting and stacking apparatus comprising;

main conveyor means for receiving said business forms and moving the same along a predetermined main path;

first and second branch conveyor means communicating with said main conveyor means, for moving said forms along either a first or a second branch delivery path;

selectively operable diverting gate means for diverting form sets to one of said first or said second branch paths selectively;

first and second stacking means, communicating with said first and second branch conveyor means, said first and second stacking means being adapted to receive form sets from their respective said conveyor means, and assemble the same into stacks of form sets, said first and second stacking means being located one above the other, at predetermined first and second levels and wherein each of said stacking means comprises rotary stacking members having a plurality of fingers, defining generally open-ended slots, said fingers being mounted for rotation on a spindle, and being oriented in relation to a said respective branch conveyor means to receive form sets delivered therefrom in said slots, said finger means being rotatable with said form sets located in said slots;

ejector members extending between said finger means, whereby to intercept form sets carried in said slots, and eject the same therefrom, to form a stack;

vibration means operable to generate repetative vibration movements;

coupling means connecting said vibration means with said ejector members, whereby to vibrate said ejector members to and fro, thereby applying a jogging action to form sets at said stacking means during stacking;

a delivery table located at said first level;

movable hoist means located between said first and second stacking means and said delivery table;

power-operated means for moving said hoist means into registration with one or other of said first and second stacking means, whereby to receive a stack of business forms therefrom;

conveyor means on said hoist means, intermittently operable to receive a stack of forms from a said stacking means, and subsequently to transfer such stack from said hoist means onto said delivery table, and, counting means for counting form sets moving along said first or second branch conveyor means respectively, and connected with said gate means for operating the same to switch delivery of form sets from one of said first or second branch conveyor means to the other, when a predetermined count of form sets has been recorded on said counting means.

2. Apparatus as claimed in claim 1 including reject means in said main conveyor means, being operable to intercept form sets passing along said main conveyor means, and reject the same before delivery to said branch conveyor means.

3. Apparatus as claimed in claim 1 including power operated means coupled with said ejector members, and operable in timed relation to the delivery of a predetermined count of form sets at a said stacking means, whereby to move said ejector members relative to said stacking means, and move a completed said stack of form sets away therefrom.

4. Apparatus as claimed in claim 3 and including guide arms located in parallel spaced apart relation to said ejector members, for cooperating therewith and receiving and guiding said form sets from said curved fingers, and controlling the same to form a uniform stack, and including swingable mounting means, carrying said arms, and power operated rotation means for procuring swinging of said arms between an upright guiding position and a substantially horizontal released position, said power operated means being operated in timed relation to the delivery of a predetermined count of form sets at a stacking unit, whereby to swing said arms and permit ejection of a said stack of form sets therefrom.

5. Apparatus as claimed in claim 1 including conveyor means on said delivery table operable to receive a said stack from said hoist means.

6. Apparatus as claimed in claim 1 wherein said conveyor means on said hoist means is intermittently operable so as to move when said hoist means is stationary, in registration with a said stacking means, and to be stationary when said hoist means is moving from one stacking means to the other, and is further movable when said hoist means is in registration with said delivery table so as to deliver a stack from said hoist means onto said table.

7. Apparatus for counting and stacking business forms as claimed in claim 1 wherein said main conveyor means comprises upper and lower belt members, roller means supporting said upper and lower belt members, and drive means for driving the same in opposite directions, so that adjacent portions of said belt members are running together at the same speed, and are adapted for contacting upper and lower surfaces of said form sets, and wherein said lower belt means of said main conveyor terminates before the termination of said upper belt means, and wherein said first branch conveyor is located above said second branch conveyor and comprises upper and lower belt means, and roller means supporting the same with adjacent portions thereof adapted to move in unison, in contact with upper and lower surfaces of said form sets, and drive means for driving the same, and wherein said upper belt means of said first branch conveyor comprises a continuation of said upper belt means of said main conveyor, beyond the termination of said lower belt means of said main conveyor, and said lower belt means of said first branch conveyor commences at the diverting gate means, and wherein said second branch conveyor comprises upper and lower belt means, and roller means supporting the same with adjacent portions thereof adapted to run in opposite direction in contact with form sets sandwiched therebetween, and including drive means for driving the same, and wherein said lower belt means of said second branch conveyor commences adjacent the termination of said lower belt means of said main conveyor, and cooperates with said upper belt means of said main conveyor for a predetermined distance up to said diverting gate means and thereafter separates therefrom, the upper belt means of said second branch conveyor commencing at said diverting gate means.

8. Stacking apparatus for the stacking of form sets of the type comprising a plurality of sheets of material, bonded together along at least one edge, such as for example multi-part business form sets and the like, said stacking apparatus being adapted to be located adjacent a form set delivery system, for receiving form sets in succession from said delivery system, and forming the same into a stack, said stacking apparatus comprising;

a plurality of generally disc-like members mounted side by side for rotation on common shaft means;

generally arcuate slotted openings formed in said disc members, being spaced radially therearound, and making a semispiral curved shape therein, with said slots in adjacent said disc members being aligned with one another, whereby a said form set may be received in registering slots of at least two adjacent said disc members;

form discharge arms extending upwardly from beneath said disc members, at least one of said discharge arms extending between said disc members for contacting a said form set along one edge and ejecting the same from said slots at a predetermined location;

drive means for rotation of said common shaft whereby to rotate said disc members mounted thereon in unison to receive a said form set from a predetermined delivery point and transfer the same in a rotary manner to a predetermined ejection point therebeneath, support means below said disc members for receiving said form sets adjacent said ejection point, and, pusher means connected to said discharge arms and operable to push the same, and to retract them, along a predetermined path, for discharging a stack of form sets located on said support means, retraction of said discharge arms leaving said support means clear for the formation of another said stack.

9. Stacking apparatus as claimed in claim 8 including side guide support members extending upwardly from said support means, and side guides movably mounted thereon, and jogger means connected with said side guide support members for vibrating the same.

10. Stacking apparatus as claimed in claim 8 including jogger means connected with said discharge arms in their retracted position for vibrating the same during formation of a said stack, and disengaging therefrom upon pushing thereof by said pusher means.

11. Stacking apparatus as claimed in claim 10 including spring means connecting said discharge arms and said pusher means, and yieldable in response to operation of said jogger means to permit vibrating action of said discharge arms to occur without transmitting such action to said pusher means.

12. Stacking apparatus as claimed in claim 8 including adjustable mounting means for mounting said disc members on said shaft means, whereby said disc members may be adjusted along said shaft means to provide a greater or lesser spacing therebetween.

13. Stacking apparatus as claimed in claim 8 including end edge guides extending upwardly from said support means for guiding an edge of a said form set opposite to said discharge arms, and being movable into a retracted position, upon completion of a said stack so as to permit ejection of said stack from said support means by said discharge arms.

14. Stacking apparatus as claimed in claim 13 including adjustable means connected with said end edge guides for moving the same towards and away from said discharge arms to accommodate forms of different size.

* * * * *